US012402675B2

(12) United States Patent
Postolek

(10) Patent No.: US 12,402,675 B2
(45) Date of Patent: Sep. 2, 2025

(54) GAITER AND RELATED METHODS

(71) Applicant: Filip Postolek, Simi Valley, CA (US)

(72) Inventor: Filip Postolek, Simi Valley, CA (US)

(73) Assignee: IP MILL HOLDINGS LLC, Los Angeles, CA (US)

( * ) Notice: Subject to any disclaimer, the term of this patent is extended or adjusted under 35 U.S.C. 154(b) by 100 days.

(21) Appl. No.: 18/096,816

(22) Filed: Jan. 13, 2023

(65) Prior Publication Data

US 2023/0276876 A1 Sep. 7, 2023

Related U.S. Application Data

(60) Provisional application No. 63/299,696, filed on Jan. 14, 2022.

(51) Int. Cl.
*A41D 17/00* (2006.01)

(52) U.S. Cl.
CPC ..... *A41D 17/005* (2013.01); *A41D 2300/32* (2013.01); *A41D 2300/33* (2013.01); *A41D 2400/80* (2013.01)

(58) Field of Classification Search
CPC .. A41D 17/00; A41D 17/005; A41D 2300/32; A41D 2300/33; A41F 9/025; A41F 17/00; A41F 17/04; A41F 11/12; A43B 23/06
USPC ..... D2/747, 901
See application file for complete search history.

(56) References Cited

U.S. PATENT DOCUMENTS 945,420 A * 1/1910 Rosenwasser ..... A41D 17/00 36/2 R
1,272,386 A * 7/1918 Cook ..... A41D 17/00 36/2 R
1,801,562 A * 4/1931 Luft ..... A41F 17/04 2/232
1,831,045 A * 11/1931 Sundback ..... A41D 17/005 24/390
1,885,527 A * 11/1932 Luft ..... A41D 17/00 2/232
2,087,110 A * 7/1937 Manolis ..... A41D 17/005 36/2 R
2,087,357 A * 7/1937 Persson ..... A41F 9/02 2/237
2,126,022 A * 8/1938 Manolis ..... A41D 17/00 36/2 R
2,262,564 A * 11/1941 Strother ..... A41D 17/00 D2/901
2,541,713 A * 2/1951 Neilson ..... A41F 9/025 2/237

(Continued)

FOREIGN PATENT DOCUMENTS

EP 0750856 A1 1/1997
JP 3049371 U 6/1998

(Continued)

*Primary Examiner* — Heather Mangine
(74) *Attorney, Agent, or Firm* — Andrew D. Dorisio; Dickinson Wright PLLC

(57) ABSTRACT

An apparatus for being worn on a lower leg of a wearer. The apparatus includes a gaiter including one or more of the following: (a) a connector for connecting one or more accessories; (b) an adjustable strap including a retainer for connecting with a lace; (c) an adjustable stirrup; or (d) an upper end adapted for holding the gaiter in place on the lower leg.

20 Claims, 5 Drawing Sheets

(56) References Cited

U.S. PATENT DOCUMENTS 2,687,531 A * 8/1954 Frechette ..... A41D 10/00 2/232
3,200,414 A * 8/1965 Sternberg ..... A41F 17/04 2/232
3,538,914 A * 11/1970 Myers ..... A61F 13/085 450/142
3,643,264 A * 2/1972 Rector ..... A44B 18/00 2/2.17
3,839,739 A * 10/1974 Engel ..... A41D 1/082 2/232
4,001,953 A * 1/1977 Fugere ..... A63B 71/1225 2/22
4,896,437 A * 1/1990 Johnson ..... A41D 17/00 2/22
5,016,290 A * 5/1991 Askew ..... F16G 11/106 2/270
5,119,510 A * 6/1992 Schilling ..... A42B 1/045 2/202
5,203,754 A * 4/1993 Maclean ..... A63B 21/4015 482/121
D336,972 S * 7/1993 Diaz ..... D2/901
5,251,386 A * 10/1993 Diaz ..... A43B 3/16 36/1.5
5,642,573 A * 7/1997 Brown ..... A43B 3/02 36/132
5,727,254 A * 3/1998 Dicker ..... A41D 31/18 2/69
5,887,359 A * 3/1999 Falguere ..... A41D 17/00 36/1.5
6,088,840 A * 7/2000 Im ..... A42B 3/324 2/DIG. 2
6,094,745 A * 8/2000 Fulton ..... A41D 17/00 2/242
6,185,752 B1 * 2/2001 Hendersen ..... A41D 17/00 2/242
6,301,803 B1 * 10/2001 Patterson ..... A41D 17/00 36/1.5
6,477,788 B1 * 11/2002 Chen ..... A43B 3/166 36/1.5
D551,828 S * 10/2007 Winjum ..... D2/901
D655,896 S * 3/2012 Kang ..... D2/901
8,468,658 B1 * 6/2013 Rife ..... A41F 9/025 24/265 AL
8,973,169 B2 * 3/2015 Curtis ..... A41D 13/0012 2/249
D869,840 S * 12/2019 Chaney ..... D2/903
D1,012,441 S * 1/2024 Postolek ..... D2/901
2002/0092138 A1 * 7/2002 Spiller ..... A44B 18/00 24/306
2002/0174565 A1 * 11/2002 Roelofs ..... A43C 11/12 36/2 R
2003/0093918 A1 * 5/2003 Challe ..... A43B 3/0031 36/1.5
2003/0097765 A1 * 5/2003 Chen ..... A43B 3/18 36/2 R
2005/0108800 A1 * 5/2005 White ..... A43B 7/32 2/2.5
2005/0235522 A1 * 10/2005 Crowley, II ..... A43B 7/12 36/2 R
2007/0204373 A1 * 9/2007 Loyens ..... A41D 19/01505 2/16
2008/0201915 A1 * 8/2008 Obiols ..... F16L 3/137 24/306
2008/0289225 A1 * 11/2008 Ali ..... A41F 17/02 24/72.1
2009/0083899 A1 * 4/2009 Herman ..... A41F 17/04 2/338
2009/0144876 A1 * 6/2009 Pena ..... A41D 13/0007 5/81.1 R
2010/0139048 A1 * 6/2010 Pesic ..... A45F 5/00 224/660
2010/0162467 A1 * 7/2010 Rondon ..... A41F 11/18 2/243.1
2011/0072545 A1 * 3/2011 Bennett ..... A41D 13/0543 2/229
2011/0167538 A1 * 7/2011 Germann ..... A43B 3/242 2/243.1
2011/0209264 A1 * 9/2011 Williams ..... A41D 13/0015 2/69
2012/0272467 A1 * 11/2012 Forbes ..... A63B 57/60 15/114
2013/0031698 A1 * 2/2013 Valles ..... A41D 1/08 2/243.1
2013/0036626 A1 * 2/2013 Briant ..... A43B 3/242 36/58.5
2014/0026291 A1 * 1/2014 Webster ..... A41B 3/00 2/244
2014/0075784 A1 * 3/2014 Webb ..... A43C 1/06 36/109
2014/0230115 A1 * 8/2014 Shelley ..... A45F 3/14 2/69
2015/0135394 A1 * 5/2015 Bracken ..... A41D 17/02 2/69
2015/0351458 A1 * 12/2015 Fisher ..... A41B 7/02 2/270
2016/0165985 A1 * 6/2016 Moltrup ..... A41F 9/002 2/321
2016/0317853 A1 * 11/2016 Benocci ..... A63B 21/4009
2017/0006946 A1 * 1/2017 Friedman ..... A41D 13/0543
2017/0065009 A1 * 3/2017 Kim ..... A43C 15/06
2018/0084850 A1 * 3/2018 Smith ..... A41D 27/08
2018/0184733 A1 * 7/2018 LeMarbe ..... A41D 13/0518
2018/0292177 A1 * 10/2018 Roby ..... A41D 13/0512
2018/0360166 A1 * 12/2018 Lockwood ..... A41D 13/0543
2019/0150535 A1 * 5/2019 Shorten ..... A41D 17/005
2020/0085123 A1 * 3/2020 Achtymichuk .... A63B 21/0407
2020/0345088 A1 * 11/2020 Ramsey ..... A41D 17/005
2021/0330001 A1 * 10/2021 Washington ..... A41D 17/00
2022/0095725 A1 * 3/2022 Lynn ..... A41F 9/00
2022/0160065 A1 * 5/2022 Pagano ..... A41F 9/025
2022/0248787 A1 * 8/2022 Ng ..... A41D 27/085
2022/0256949 A1 * 8/2022 Richardson ..... A41D 31/10
2023/0021135 A1 * 1/2023 Waterman ..... A41D 17/005
2023/0079499 A1 * 3/2023 Postolek ..... A44B 18/0073 2/270
2023/0240401 A1 * 8/2023 Wagner ..... A41D 1/06 223/95
2023/0276876 A1 * 9/2023 Postolek ..... A41D 17/005 36/2 R
2023/0337768 A1 * 10/2023 Ramsey ..... A41D 17/00
2024/0023656 A1 * 1/2024 Schneider ..... A45F 5/02
2024/0032634 A1 * 2/2024 Rodgers ..... A41F 17/02

FOREIGN PATENT DOCUMENTS

KR 101623899 B1 5/2016
WO WO-2006125244 A1 * 11/2006 ..... A41D 17/00

* cited by examiner

GAITER AND RELATED METHODS

CROSS-REFERENCE TO RELATED APPLICATION

The present disclosure claims the benefit of Provisional Patent Application No. 63/299,696, filed on Jan. 14, 2022, the contents of which are incorporated by reference in it's entirety.

TECHNICAL FIELD

This application relates to the clothing arts and, more particularly, to a gaiter and related methods.

BACKGROUND

In many outdoor activities, it is desirable to wear a gaiter. Such gaiters typically run from the bottom of the foot to mid-calf and are made with sturdy weather-resistant materials. This design and fabrication protects the foot and lower leg from deep snow, wet underbrush or debris that you can pick up while hiking, cross-country skiing or mountaineering, as well as from insects and the elements.

Many past designs of gaiters suffer from several limitations. For one, they can be difficult to put on, especially over footwear. For this reason, they are often made oversized, and thus do not stay up, especially when worn under extreme conditions, such as wilderness hiking or in inclement weather. Past gaiters also lack any means of holding or storing objects, which would be especially useful to provide ready access.

Accordingly, a need is identified for a gaiter that addresses the foregoing issues and possibly others that have yet to be discovered.

SUMMARY

According to a first aspect, an apparatus includes a gaiter including a connector for connecting one or more accessories.

According to a second aspect, an apparatus includes a gaiter including an adjustable strap including a retainer for connecting with a lace of an item of footwear.

According to a third aspect, an apparatus includes a gaiter including an adjustable stirrup.

According to a fourth aspect, an apparatus includes a gaiter including an upper end having a drawstring.

According to a fifth aspect, a method of using a gaiter in connection with footwear, the method includes adjusting the length of a loop associated with the gaiter.

According to a sixth aspect, a method of using a gaiter includes attaching at least one accessory to a connector on the gaiter.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

FIG. 3C schematically depicts a partial view of a strap for attaching the gaiter of FIG. 1 to footwear, according to one or more embodiments shown and described herein:

FIG. 3D schematically depicts a partial view of the strap of FIG. 3C being attached to the gaiter, according to one or more embodiments shown and described herein:

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized, and that process or other changes may be made without departing from the scope of the disclosure. The following detailed description is not to be taken in a limiting sense, and the scope of the invention is defined only by the appended claims and their equivalents.

Figure 2:
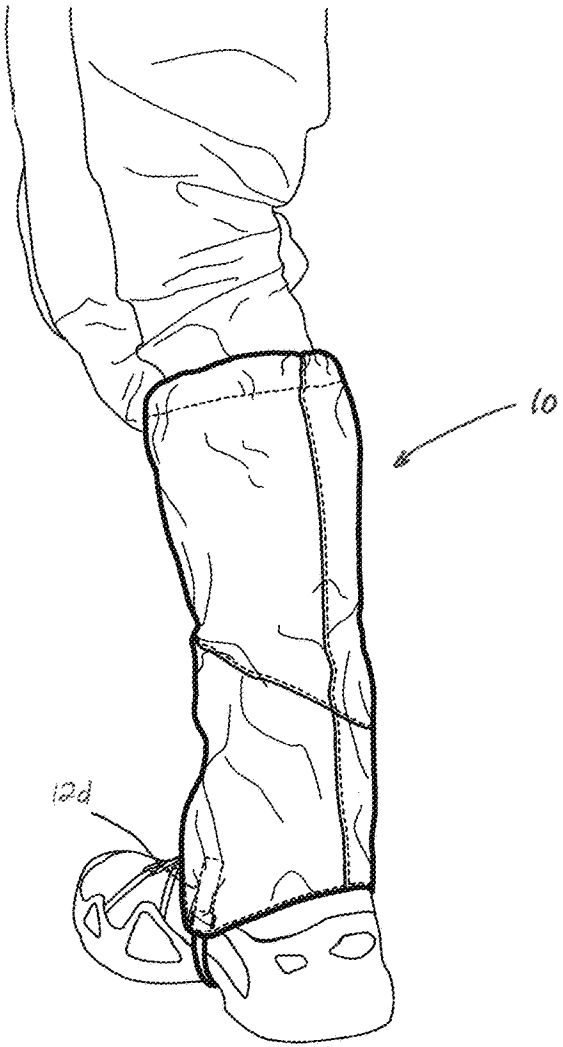
FIG. 2 schematically depicts a rear perspective view of the gaiter of FIG. 1, according to one or more embodiments shown and described herein.
Figure 1:
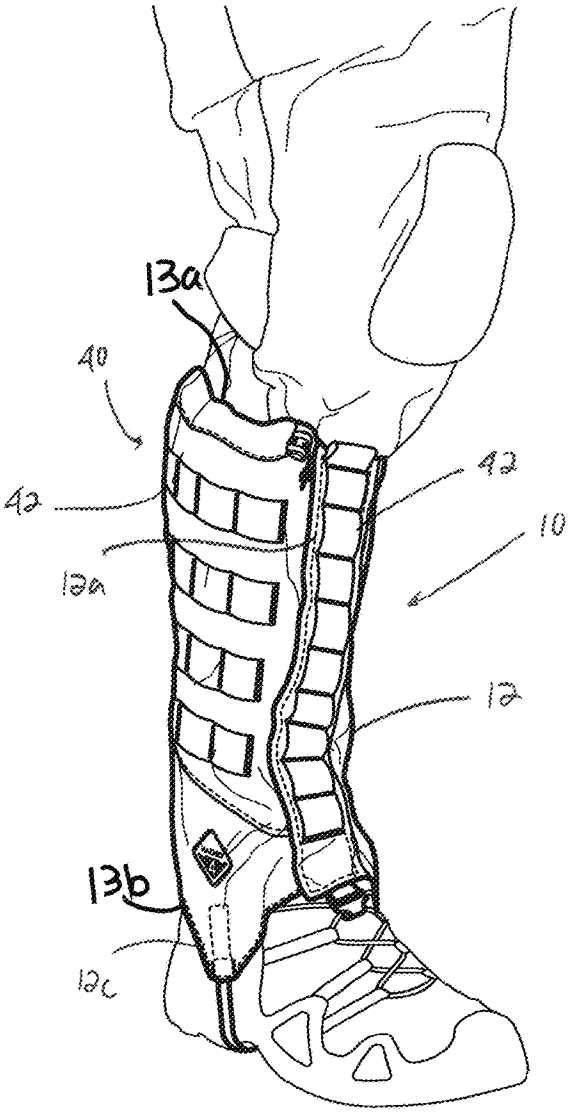
FIG. 1 schematically depicts a front perspective view of a gaiter, according to one or more embodiments shown and described herein.

Reference is now made to FIGS. 1 and 2, which depict a gaiter 10 according to one aspect of the disclosure. As can be understood, the gaiter 10 includes an elongated body 12 with a front flap 12*a* designed to overlap with the remainder of the body and form a tubular sleeve. The elongated body 12 includes an upper end 13*a* and an opposite lower end 13*b*, where the tubular sleeves has openings at the upper end 13*a* and the lower end 13*b* for a user to extend a leg therethrough. The front flap 12*a* may extend along the body 12 between the upper end 13*a* and the lower end 13*b*, and may connect to the body 12 by a releasable or removable connector, such as for example a hook and loop (i.e., VELCRO®) arrangement. For example, as depicted in FIGS. 3C and 3D, a first male connector (hook) in the form of an elongated strip 14*a* may be provided on the body 12, and a female connector (loop) also in the form of a strip 14*b* provided along the corresponding interior surface of the flap 12*a* for selectively coupling to the strip 14*a*. However, it is contemplated and possible that the arrangement could be reversed, or other connectors such as snaps, magnets, or the like, could be used.

Figures 3, 3A, 3B:
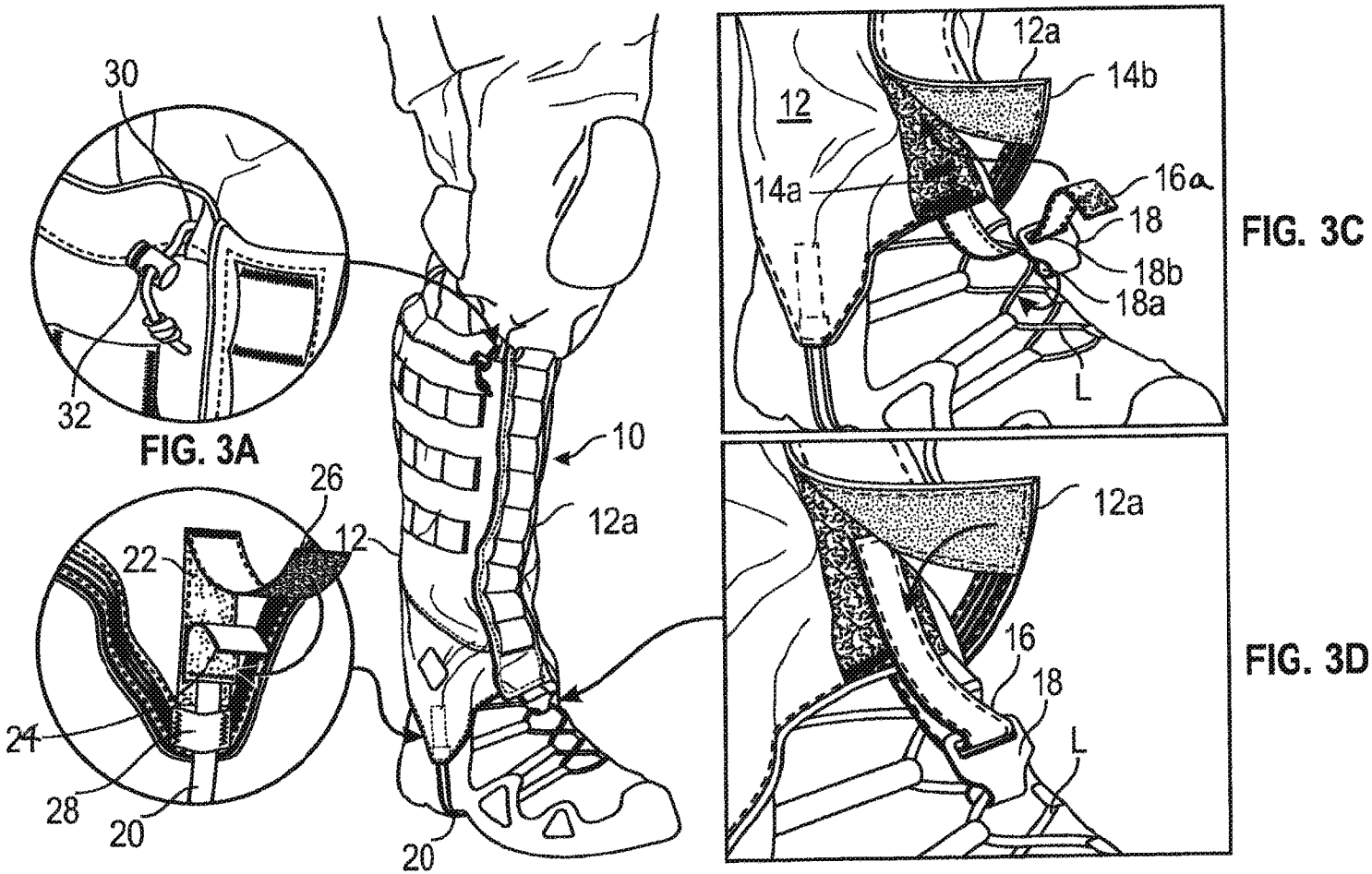
FIG. 3 schematically depicts a front perspective view of the gaiter of FIG. 1, according to one or more embodiments shown and described herein.
FIG. 3A schematically depicts a partial view of a drawstring and lock for the gaiter of FIG. 1, according to one or more embodiments shown and described herein.
FIG. 3B schematically depicts a partial view of a stirrup for the gaiter of FIG. 1, according to one or more embodiments shown and described herein.

Referring to FIGS. 1 and 3, the gaiter 10 may also include side flaps 12*c*, 12*d* that extend from the lower end 13*b* of the body 12 to be configured for covering an upper sidewall of the footwear corresponding to the wearer's ankle. The gaiter 10 may include a stirrup 20 that extends between the side flaps 12*c*, 12*d*, which is designed to loop around the wearer's foot and retain the lower end 13*b* of the body 12 in contact or proximity with the wearer's shoe. Referring to FIGS. 3 and 3B, the stirrup 20 may include a connector at each end adapted to connect with a similar, but oversized (at least in length) connector on the gaiter 10, such as for example mating hook and loop fasteners 22, 24.

A cover 26, or flap, may also be provided for covering the connection once established, which may be along an inside surface of the side flaps 12*c*, 12*d* of the gaiter 10. The cover 26 may also comprise a connector for connecting with the fasteners on the cover, the gaiter, or both. Again, this allows for the length of the stirrup 20 to be readily adjusted to accommodate different situations in terms of size of the corresponding midsection of the footwear.

A retainer 28 may also be provided for retaining the stirrup 20 on the gaiter 10, where the retainer 28 may be sewn or otherwise coupled to the respective side flap 12*c*, 12*d*, to allow for the stirrup 20 to extend therethrough. While FIG. 3B depicts the fasteners 22, 24 and the cover 26 attached to side flap 13*a*, the gaiter 10 similarly includes fasteners 22, 24 and the cover 26 on the side flap 13*b*.

Referring again to FIGS. 3C and 3D, adjacent to the portion of the body 12 including the strip 14*a* is an adjustable strap 16 adapted to receive a retainer 18, such as a clip, with a hook 18*a* for engaging a shoe or boot lace L. The strap 16 may be coupled to the body 12 at one end of the strap 16 to extend from the body 12 and have a free end for attaching the body 12 to the wearer's footwear. The free end of the strap 16 may extend through an eyelet 18*b* of the retainer 18 and then attach to the flap 12*a* to retain the retainer 18 on the strap 16. However, it is contemplated and possible that each end of the strap 16 is removably attachable to the body 12.

The strap 16 includes a connector 16*a* adapted to connect with the strip 14*a*, and thus may loop back to a suitable location in order to form a connection once the lace L is engaged. The flap 12*a* may then be secured in place, engaging the connector 16*a* with the strips 14*a*, 14*b*, thus protecting the strap 16 from becoming dislodged and releasing the retainer 18. With both ends of the strap 16 attached to the body 12 with the retainer 18 coupled thereto, the retainer 18 may be engaged with the wearer's footwear by hooking the hook 18*a* onto a lace or other feature on the footwear. The ability to adjust the length of the loop formed and thus the position of the retainer 18 allows for adjustments to be made to ensure a proper fit, which helps to ensure the gaiter remains in a proper position.

Figure 3E:
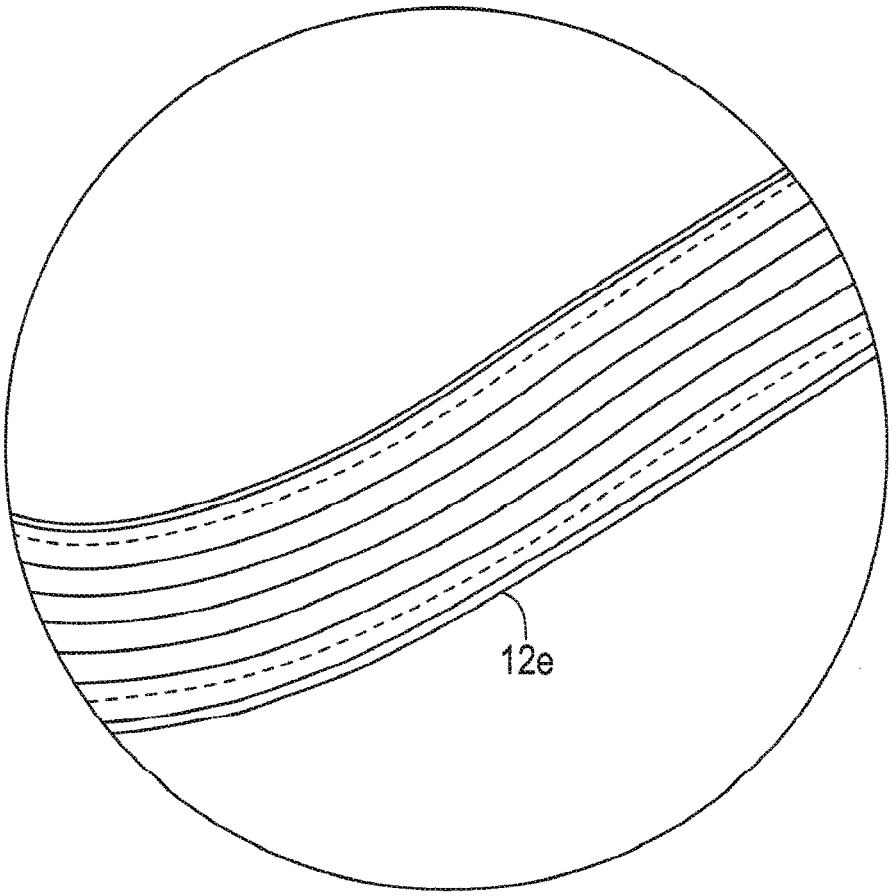
FIG. 3E schematically depicts a partial view of a high friction surface provided on the inner surface of the gaiter of FIG. 1, according to one or more embodiments shown and described herein.

Referring to FIGS. 3 and 3A, along the upper end 13*a* of the gaiter 10 that will lie adjacent to the wearer's knee, an adjustable retainer may also be provided, which may take the form of a drawstring 30 with a suitable lock 32. The drawstring 30 may extend through a passage in the gaiter 10 to be coupled to the gaiter 10, and thus be used to cinch and lock it at a particular diameter. Referring to FIG. 3E, an opposite inner surface 12*e* of the body 12 may also be provided with a tacky material or "grippy" surface that has a friction that is greater than a friction of rest of the body 12 for retaining the upper end 13*a* of the body 12 in position. This feature, together with the drawstring 30, helps to prevent the gaiter 10 from falling down along a lower portion of the leg of the wearer. The high friction surface may be in the form of a strip that is formed of a material with a friction that restricts the gaiter 10 from moving relative to the wearer, such as, for example, a rubber. Such a surface may also be provided along the lower open end of the gaiter 10.

FIG. 3 also illustrates that the body 12 of the gaiter 10 may comprise more than one material. For example, a lower portion of the body 12 for partially covering the foot and ankle may comprise a thicker, more durable/semi-rigid material, such as 1000D CORDURA® fabric. The upper portion may instead comprise a soft-shell, breathable fabric, such as smooth faced, stretchy, tightly-woven fabric that usually consists of nylon blended with elastane, in order to promote comfort.

Turning back to FIGS. 3 and 4, it can also be understood that various connectors 40 may be provided for connecting accessories or gear 50 to the gaiter 10. The connectors may comprise a plurality of so-called Modular Lightweight Load-carrying Equipment (MOLLE) loops 42, which may be approximately 1.5" (3.8 cm) wide and located approximately 1" (2.5 cm) apart from each other. Multiple rows of such loops (four shown, but more or fewer may be provided) may be located along an outer side of the gaiter 10, such as coupled to and extending along a sidewall 52 of the gaiter 10, coupled to and extending along the front flap 12*a*, or both, which thus allows for an object to be connected by being passed or woven through the loops. The loops 42 may also be provided along the front flap 12*a* of the body 12, and the drawstring 30 may pass through one of these loops on the front flap, such as the uppermost one. The connectors 40 may include a plurality of spaced rows of the loops 42 along both the front flap 12*a* and the sidewall 52.

Figure 4:
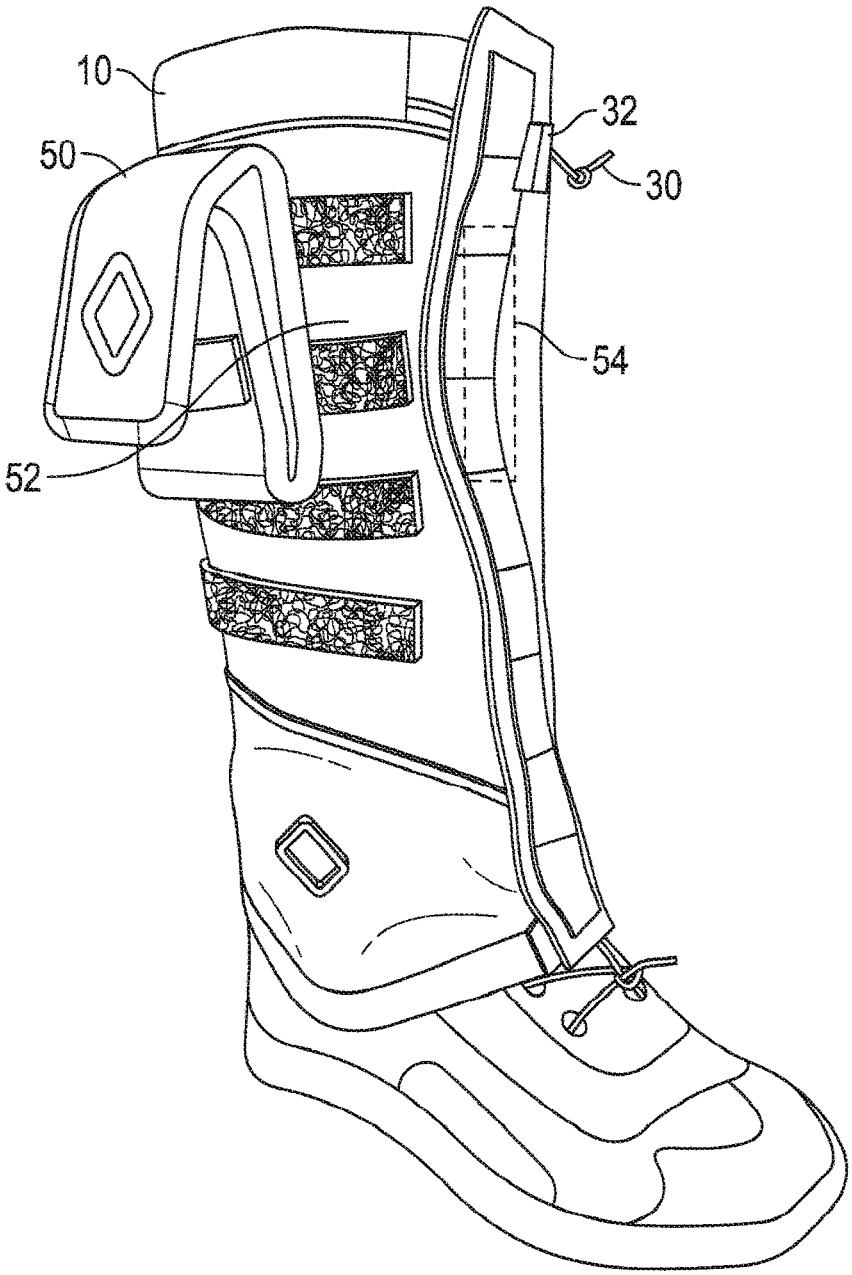
FIG. 4 schematically depicts a front perspective view of the gaiter of FIG. 1 with gear attached to the gaiter of FIG. 1, according to one or more embodiments shown and described herein.

Using this arrangement, it can be appreciated that the gaiter 10 not only performs its protective function, but also serves as a location for holding or storing accessories, such as for example a knife in a sheath (see FIG. 4, noting connected pouch 50). As can be appreciated, this provides a removable storage system on the lower leg for survival gear, knives, tourniquets etc., so such accessories are readily accessible when needed, and without the need to remove root through a pocket or search a pack.

In certain embodiments, the gear 50) may be a protector 54 for attaching to the connectors 40 of one of the front flap 12*a* and the sidewall 52 to provide protection for the wearer's legs. The protector 54 may be formed of a material that absorbs impact to the wearer's legs, such as when climbing over solid structures, the material being, for example, such as rubber. In embodiments, the protector 54 may be a 0.5 inch thick serrated strip pad that attaches to the connectors 40 along the front flap 12*a* to protect a length of a shin of the wearer. In other embodiments, the protector 54 may be a shin-guard that is, for example, made of a rigid material such as plastic, metal, or the like, and attachable to one or more of the connectors 40.

Figure 5:
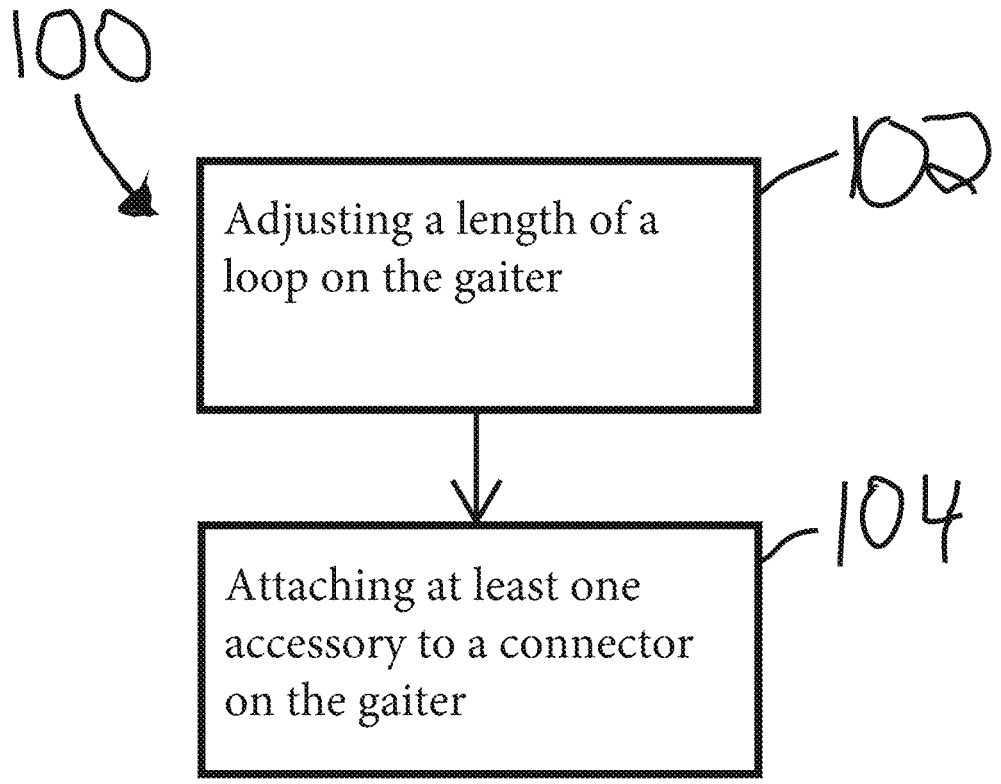
FIG. 5 depicts a flowchart of a method for using the gaiter of FIG. 1, according to one or more embodiments shown and described herein.

Referring to FIG. 5, a flowchart of a method 100 for using the gaiter 10 is depicted. The method 100 includes, at step 102, adjusting the length of the stirrup 20 by moving the stirrup 20 relative to the loop fastener 22 and attaching the loop fastener 24 attached to the stirrup 20 to the loop fastener 22, and covering the loop fasteners 22, 24 with the cover 26. The method 100 may further include adjusting a length of the strap 16 and retainer 18 by moving the strap 16 relative to the flap 12*a* and attaching the connector 16*a* to the connector 14*a* on the body 12 of the gaiter 10. The method 100 may further include adjusting a length of the drawstring 30 by moving the drawstring 30 through the lock 32 and releasing the lock 32 to lock the drawstring 30 in place. The method 100 includes, at step 104, attaching an accessory, such as gear 50, to one of the connectors 40 on the gaiter 10.

As used herein, the following terms have the following meanings:

"A", "an", and "the" as used herein refers to both singular and plural referents unless the context clearly dictates otherwise. By way of example, "a compartment" refers to one or more than one compartment.

"About," "substantially," or "approximately," as used herein referring to a measurable value, such as a parameter, an amount, a temporal duration, and the like, is meant to encompass variations of +/−20% or less, including +/−10% or less, +/−5% or less, +/−1% or less, and +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Although the invention has been described in conjunction with specific embodiments, many alternatives, modifications, and variations will be apparent to those skilled in the art. Accordingly, it embraces all such alternatives, modifications, and variations that fall within the appended claims' spirit and scope. All publications, patents and patent applications mentioned in this specification are herein incorporated in their entirety by reference into the specification, to the same extent as if each individual publication, patent or patent application was specifically and individually indicated to be incorporated herein by reference. In addition, the identification of any reference in this application shall not be construed as an admission that such reference is available as prior art to the present disclosure.

What is claimed is:

1. An apparatus for partially covering a leg of a wearer including an item of footwear, comprising:

a gaiter including an elongated body having a first flap with a closed position and an open position; and an adjustable strap including a first retainer adapted for connecting to the item of footwear, the adjustable strap being captured in place directly in-between the first flap and a portion of the body adapted for mating with an interior surface of the first flap when the first flap is in the closed position, and being removable from the gaiter when the first flap is in the open position.

2. The apparatus of claim 1, wherein the first flap is a front flap extending from an upper end to a lower end of the gaiter.

3. The apparatus of claim 1, wherein the first flap includes at least one loop adapted for connecting with an accessory.

4. The apparatus of claim 3, wherein the at least one loop comprises a plurality of vertically spaced loops extending along the first flap.

5. The apparatus of claim 1, wherein the retainer comprises an eyelet adapted for receiving the strap and a hook adapted for connecting with the item of footwear.

6. The apparatus of claim 1, wherein the gaiter includes a first connector and the first flap includes a second connector that connects with the first connector in the closed position to capture the adjustable strap in place.

7. The apparatus of claim 1, wherein the gaiter comprises an adjustable stirrup for engaging the item of footwear.

8. The apparatus of claim 7, wherein the gaiter comprises a second retainer forming a passage for receiving one end of the stirrup, the gaiter further including a second flap including a fastener for releasably attaching to the gaiter to secure the one end of the stirrup in place.

9. The apparatus of claim 1, wherein the gaiter comprises a plurality of loops positioned in rows on the elongated body.

10. The apparatus of claim 1, wherein the gaiter is further adapted to connect to a shin guard.

11. The apparatus of claim 1, further including a pouch connected to the gaiter.

12. An apparatus for partially covering a leg of a wearer including an item of footwear, comprising:

a gaiter including an elongated body having a first flap adapted to move between a closed position and an open position; and an adjustable strap including a first retainer having an eyelet adapted for receiving the adjustable strap and including a hook for connecting to the item of footwear, the adjustable strap being captured in place directly in-between the first flap and a portion of the body adapted for mating with an interior surface of the first flap when the first flap is in the closed position, and being removable from the gaiter when the first flap is in the open position.

13. The apparatus of claim 12, wherein the first flap is a front flap extending from an upper end to a lower end of the gaiter.

14. The apparatus of claim 12, wherein the first flap includes at least one loop adapted for connecting an accessory to the gaiter.

15. The apparatus of claim 14, wherein the at least one loop comprises a plurality of vertically spaced loops extending along the first flap.

16. The apparatus of claim 12, wherein the gaiter includes a first connector and the first flap includes a second connector for connecting with the first connector in the closed position to capture the adjustable strap in place.

17. The apparatus of claim 12, wherein the gaiter comprises an adjustable stirrup for engaging the item of footwear.

18. The apparatus of claim 17, wherein the gaiter comprises a second retainer for receiving one end of the stirrup, the gaiter further including a second flap including a fastener for releasably attaching to the gaiter to secure the one end of the stirrup in place.

19. The apparatus of claim 12, wherein the gaiter comprises a plurality of loops positioned in rows on the elongated body.

20. An apparatus for partially covering a leg of a wearer including an item of footwear, comprising:

a gaiter including an elongated body including a front flap adapted to move between a closed position and an open position; and an adjustable strap including a retainer for engaging the item of footwear, the adjustable strap being captured in place directly in-between the front flap and a portion of the body adapted for mating with an interior surface of the front flap when the front flap is in the closed position, and being removable from the gaiter when the front flap is in the open position;

an adjustable stirrup for engaging the item of footwear, wherein the gaiter comprises a side flap including a fastener for releasably attaching to the gaiter to secure the one end of the stirrup in place.

* * * * *